US008403599B2

(12) United States Patent
Hawkins et al.

(10) Patent No.: US 8,403,599 B2
(45) Date of Patent: Mar. 26, 2013

(54) APPARATUS FOR LIFTING HEAVY STRUCTURES

(75) Inventors: Kelly S. Hawkins, Centralia, MO (US); Randal L. Dikeman, Vinita, OK (US); Bernard A. Steinkamp, Centralia, MO (US)

(73) Assignee: Hubbell Incorporated, Shelton, CT (US)

( * ) Notice: Subject to any disclaimer, the term of this patent is extended or adjusted under 35 U.S.C. 154(b) by 644 days.

(21) Appl. No.: 12/078,531

(22) Filed: Apr. 1, 2008

(65) Prior Publication Data

US 2009/0245942 A1 Oct. 1, 2009

(51) Int. Cl.
*E02D 27/48* (2006.01)

(52) U.S. Cl. ..... 405/244; 405/230

(58) Field of Classification Search ..... 405/230–232, 405/244; 52/155

See application file for complete search history.

(56) References Cited

U.S. PATENT DOCUMENTS 2,137,767 A * 11/1938 Betcone ..... 52/274
2,268,907 A * 1/1942 Scott ..... 52/762
2,846,931 A * 8/1958 Priest ..... 52/667
3,633,548 A * 1/1972 Kepple ..... 119/529
3,939,618 A * 2/1976 Murphy ..... 52/274
4,035,972 A * 7/1977 Timmons ..... 52/241
4,854,782 A * 8/1989 May ..... 405/230
5,135,201 A * 8/1992 Engel et al. ..... 254/126
5,287,666 A * 2/1994 Frascaroli et al. ..... 52/239
5,433,556 A * 7/1995 Freeman, III ..... 405/229
6,079,905 A * 6/2000 Ruiz et al. ..... 405/230
6,142,710 A * 11/2000 Holland et al. ..... 405/230
6,416,254 B1 * 7/2002 Carlson ..... 405/230
6,416,255 B1 * 7/2002 Carlson ..... 405/230
7,094,003 B2 * 8/2006 Faires et al. ..... 405/230
7,165,915 B2 * 1/2007 Queen ..... 405/244

* cited by examiner

*Primary Examiner* — Tara M Mayo-Pinnock
(74) *Attorney, Agent, or Firm* — Kevin M. Barner; Mark S. Bicks; Alfred N. Goodman

(57) ABSTRACT

An apparatus for lifting, stabilizing or enhancing load capacity of heavy objects, such as a building foundation and the like, is disclosed in which a bracket attaches to the object to be lifted and the bracket is then lifted using the apparatus which is supported by a pier or pile on an object or surface suitable for withstanding the weight of the object being lifted. The bracket includes side plates with interlocking side track pieces fitted therein to provide adequate support when under strain and also to assist in guiding the bracket in close cooperation with the pier during the lifting process.

20 Claims, 11 Drawing Sheets

APPARATUS FOR LIFTING HEAVY STRUCTURES

FIELD OF THE INVENTION

This invention relates generally to an improved apparatus for lifting and supporting structures, particularly buildings whose positions have settled, or otherwise shifted, from their original position and must be lifted, for example, to relocate the building to its original position and/or cure structural defects which may have occurred as a result of the structure having moved, or in the case of intended future loading increases caused by planned additions or other applications that may require further support. More particularly, the invention relates to a bracket used in conjunction with such an apparatus and which is structurally stronger and less expensive to manufacture than conventional brackets.

BACKGROUND OF THE INVENTION

Structures, such as houses and other low rise buildings, are often constructed on foundations which are not in direct contact with bedrock or other stable load-bearing stratum. Further, these types of foundations are typically constructed from a combination of shallow concrete spread footings with concrete slabs or other floor and wall systems. Accordingly, when these foundations are constructed on inadequate soils, support walls or foundations that impose excessive loads on the soil may, after time, settle into the ground. Occasionally, a building may settle in such a way that part of the building settles significantly lower than the rest of the building. In some instances, the entire building may settle significantly off level. Such settling may occur due to poor building materials, poor engineering of the building and/or preparation of the ground below the building, poor or changing soil conditions, and so forth. For example, if the soil under one or more particular sections of the foundation is not stable enough to resist the load(s) of the building, the foundation will sink into the soil in these areas, causing the building supported by the foundation to become unleveled, and oftentimes causing structural damage to the foundation.

Several related art systems for raising and/or supporting a building foundation or a part thereof exist. Many of these systems utilize support devices, called piles or piers, that attach to, or otherwise support, the foundation using a bracket that is attached to the pier. Typically, the pile or pier is driven into the ground until it is determined that the pier has contacted structure that is sufficient to resist the load of the building. A bracket is then attached to the foundation and contacted with the top of the pier. A jack or some other type of driving tool is then used to lift the bracket and foundation while being driven against the top of the pier.

For example, one known method for correcting foundation settling consists of employing hydraulic jacks in conjunction with piers to lift the foundation. Piers, also known as piles or pilings, are driven into the ground by hydraulic mechanisms until the pier reaches bedrock or until the pier's frictional resistance equals the compression weight of the structure. Once these piers are secured in a stable underground stratum or several stable underground strata, further lifting by the hydraulic jacks raises the level of the foundation. When the foundation is raised to the desired level, the piers are permanently secured to the foundation. The hydraulic jacks are then removed. This method of correcting the level of a foundation generally requires the excavation of a hole adjacent to or underneath the foundation in order to position and operate the lifting equipment.

Additionally, U.S. Pat. No. 4,854,782 to May, the entire contents of which are hereby incorporated by reference for all that is taught, discloses an apparatus for lifting a building foundation using a pier and a bracket attached to the object to be lifted. The bracket disclosed in May, however, is complicated and, thus, costly, to manufacture and is not sturdy enough to withstand excess loads over a certain amount.

There exists, therefore, a need for a bracket and an apparatus with which the bracket is used, for lifting and stabilizing heavy objects and structures where the bracket is inexpensive to manufacture and is significantly more sturdy than brackets currently known.

SUMMARY OF THE INVENTION

Illustrative, non-limiting embodiments of the present invention overcome the aforementioned and other disadvantages associated with related art brackets and apparatuses. Also, the present invention is not required to overcome the disadvantages described above and an illustrative non-limiting embodiment of the present invention may not overcome any of the problems described above.

More particularly, to address the above-mentioned issues related to conventional methods and devices for lifting and stabilizing heavy objects, in accordance with one embodiment of the invention a device for lifting, stabilizing or enhancing load capacities of a heavy object is provided which includes a pair of parallel side plates, each including a lateral seat portion and at least two vertical slots, each side plate having an inner surface, wherein the inner surface of each of the parallel side plates faces the inner surface of the other side plate, and each side plate further has an outer surface that faces away from the other side plate, a lifting plate having respective horizontal and vertical members, wherein the horizontal member of the lifting plate contacts the lateral seat portion of the side plates, and at least four side track pieces respectively corresponding to the vertical slots of the side plates, wherein the side track pieces are configured for an interlocking fit into the slots.

According to another embodiment, an apparatus for lifting, stabilizing or enhancing load capacities of a heavy object is provided where the apparatus includes a pier suitable to support at least the load of the heavy object, a bracket operable to engage the heavy object and the pier, the bracket having a pair of parallel side plates, a lifting plate perpendicular to and fixedly attached to the side plates at opposite ends thereof and a guide track formed by parallel side track members perpendicularly attached to opposing inside surfaces of respective side plates, and a pier platform disposed on top of the pier and having at least one guide member operable to engage the guide track of the bracket.

According to yet another embodiment of the invention, a method for lifting, stabilizing or enhancing load capacities of a heavy object is provided, where the method includes inserting a pier into the earth adjacent to the heavy object, engaging the heavy object with a bracket in alignment with a top of the pier, placing a pier platform on top of the pier, wherein the pier platform engages a guide track formed by side track pieces inserted into slots in side plates of the bracket, lifting the bracket and the heavy object, and sliding the guide track relative to the pier platform during the lifting.

According to yet another embodiment of the invention, a method for making a bracket used for lifting, stabilizing or enhancing load capacities of a heavy object is provided wherein the method includes attaching two parallel side plates to an L-shaped support member at opposite ends of the support member and inserting two side track pieces into respective slots in each of the side plates, wherein the side track pieces are perpendicular to the side plates.

As used herein "substantially", "generally", and other words of degree, are used as a relative modifier intended to indicate permissible variation from the characteristic so modified. It is not intended to be limited to the absolute value or characteristic which it modifies but rather approaching or approximating such a physical or functional characteristic.

BRIEF DESCRIPTION OF THE DRAWINGS

The aspects of the present invention will become more readily apparent by describing in detail illustrative, non-limiting embodiments thereof with reference to the accompanying drawings, in which.

DETAILED DESCRIPTION OF ILLUSTRATIVE, NON-LIMITING EMBODIMENTS

Exemplary, non-limiting, embodiments of the present invention are discussed in detail below. While specific configurations and dimensions are discussed to provide a clear understanding, it should be understood that the disclosed dimensions and configurations are provided for illustration purposes only. A person skilled in the relevant art will recognize that other dimensions and configurations may be used without departing from the spirit and scope of the invention.

Figure 1:
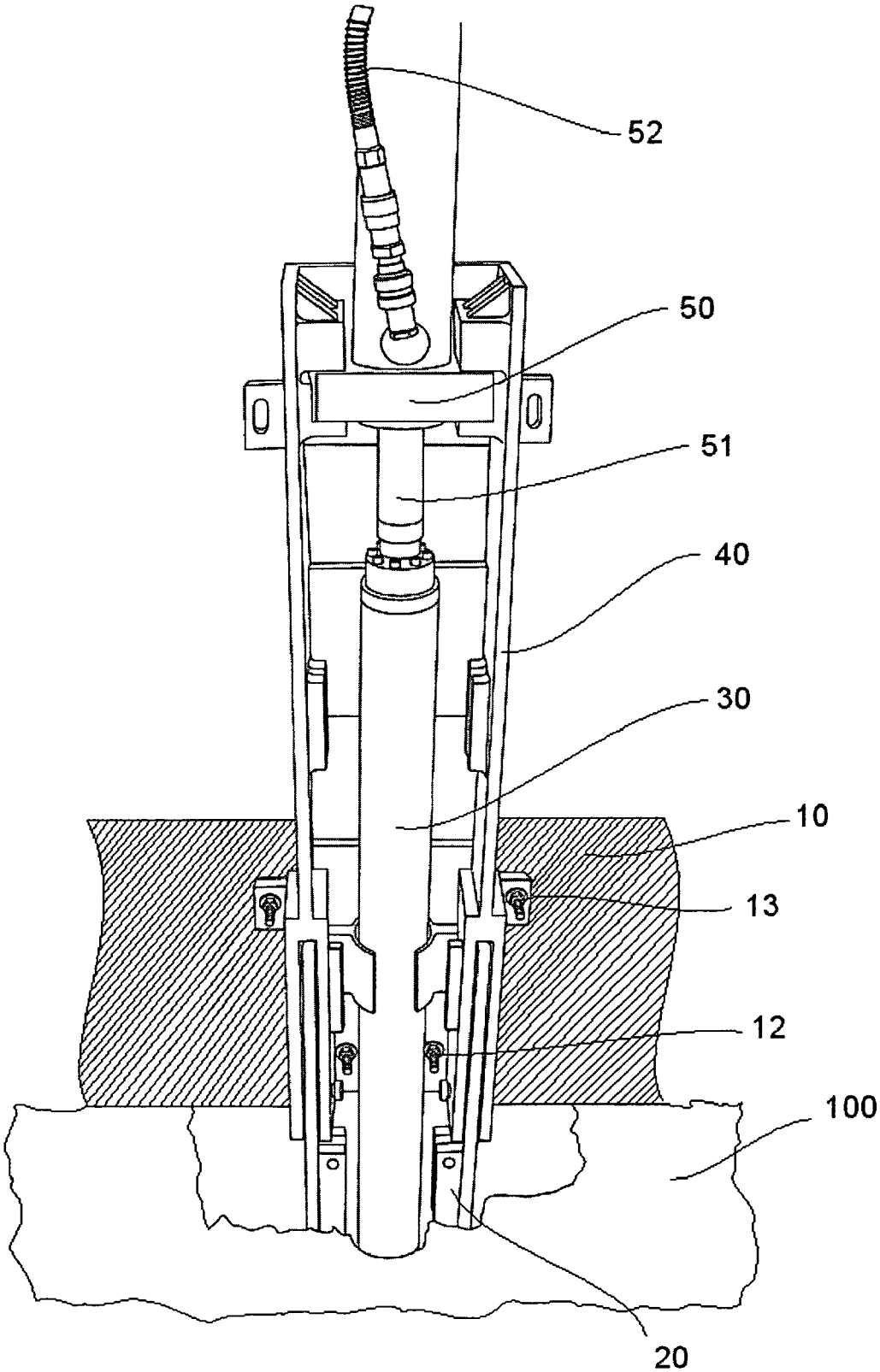
FIG. 1 is a perspective illustration of one embodiment of a lifting apparatus in accordance with the present invention.

FIG. 1 illustrates an apparatus for lifting heavy structures in accordance with one exemplary embodiment of the invention. In particular, FIG. 1 illustrates an embodiment of the invention in which a building foundation 10 is lifted. Bracket 20, described in more detail below, is securely attached to foundation 10, for example using bolts 12 driven through the vertical side face of bracket 20. Although bolts 12 are used to attach the bracket to the structure being lifted in this exemplary embodiment, those having skill in the art will understand that other attachment methods and devices can also be used. For example, if the structure being lifted is metal, the bracket could be welded directly to the structure.

Figure 2:
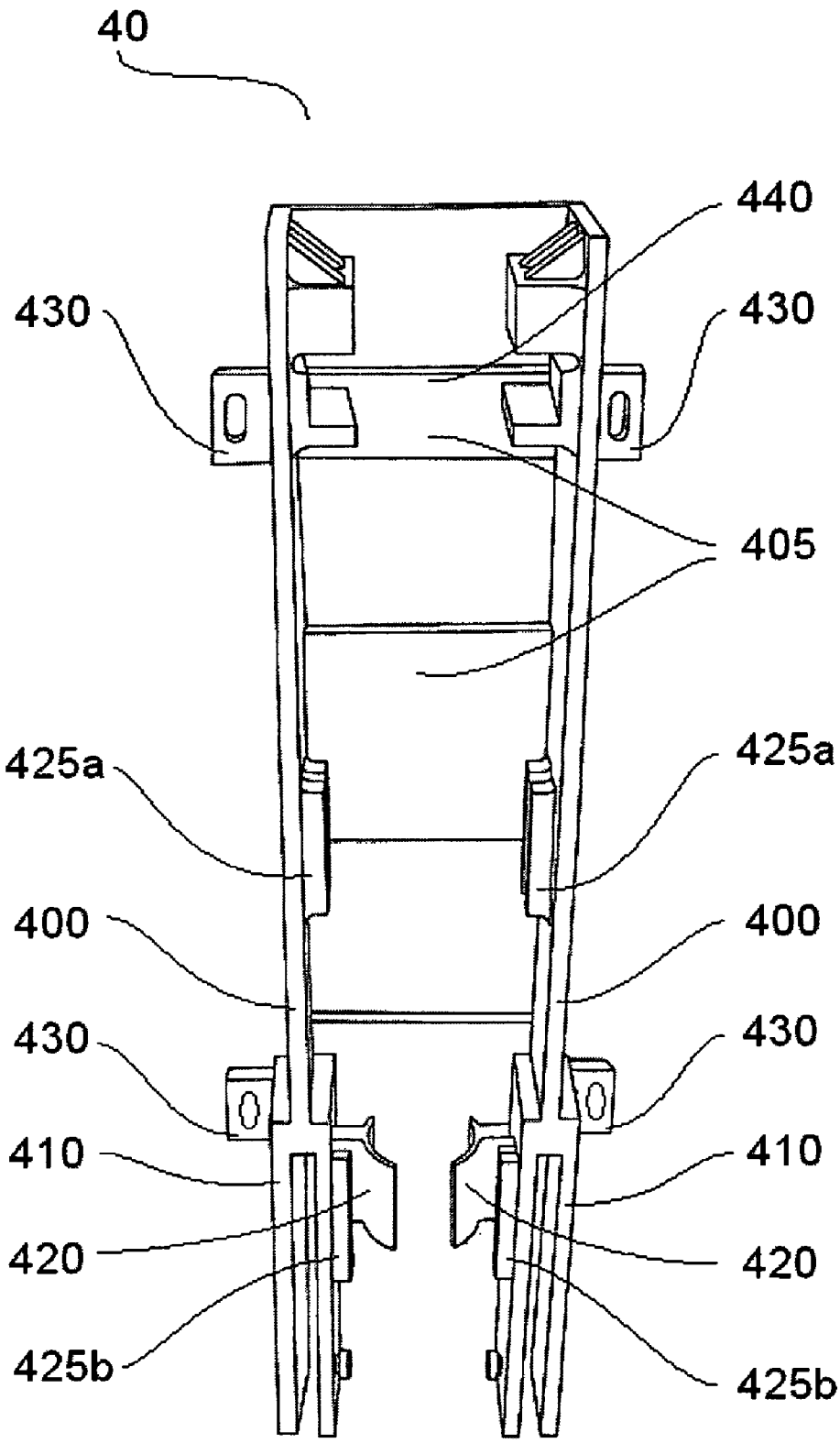
FIG. 2 is a perspective view of a pier-driving frame in accordance with one embodiment of the present invention.

Pier 30, upon which the structure will ultimately rest once the structure has been sufficiently lifted, stabilized or additional load capacity requirements achieved must be driven into the earth 100, or other supporting structure, before foundation 10, with the bracket 20 attached, is permitted to rest on it. Although many methods can be employed for driving pier 30 into the earth, according to this embodiment, a pier-driving frame 40, illustrated independently in FIG. 2, is attached to foundation 10 using bolts 13. Then, a hydraulically actuated double-acting cylinder, or some other driving tool, is used to drive the pier against the pier-driving frame 40, which is fixed to the bracket 20 which in turn reacts against the foundation 10, and into the ground. In particular, as shown in FIG. 1, cylinder 50 is attached to pier-driving frame 40 by sliding the flange of the cylinder 50 into slot 41 in the pier-driving frame 40. Cylinder rod 51 of cylinder 50 is then driven downward using hydraulic forces generated by a high pressure hydraulic pump to cylinder 50 through hose 52. Further, cylinder rod 51 contacts the top of pier 30 and pushes it downward into the ground. Because pier-driving frame 40 and bracket 20 are secured to foundation 10, as the cylinder rod 51 is forced downward, pier 30 is also forced downward into the earth 100.

While pier 30 is being driven into the ground, its alignment is aided by the pier guide tool 42 of pier-driving frame 40 which keep pier 30 in good relative alignment with bracket 20. Additionally, while pier 30 is being driven in to the ground, the pressure required to force it further into the earth is monitored. When it is determined that the force required to drive pier 30 further into the ground is sufficient to carry the load of the structure including the necessary factor of safety here foundation 10, the pier driving process is ceased. For example, this typically occurs when the pier has encountered a firm bearing strata or bedrock within earth 100. Subsequently, cylinder 50 is removed from pier-driving frame 40 and frame 40 is detached from foundation 10 and bracket 20.

At this time, pier 30 is securely in place and stabilized, and aligned with bracket 20, which is attached to foundation 10. For convenience in the lifting process, described hereafter, the top of pier 30 should be oriented below the top of bracket 20, for example, leaving enough room between the top of the bracket and the top of the pier to insert a jack, or some other lifting apparatus. Accordingly, if the top of the pier is above the top of the bracket after the pier-driving process is complete, the pier should be cut to the proper height.

FIG. 2 is a perspective view of the pier-driving frame 40 mentioned above in regard to FIG. 1. In particular, according to the embodiment shown in FIG. 2, frame 40 includes several metal components all securely attached together, for example, by welding. As shown, frame 40 includes two parallel arms 400 joined together by one or more attachment plates 405. Additionally, each arm 400 according to this exemplary embodiment includes a substantially U-shaped attachment portion 410 located at the lower end of the arm. The lower end of each arm 400 is inverse U-shaped such that the U-shaped portion can conveniently be inserted over the respective top side portions of bracket 20. In this manner, the pier-driving frame 40 and the bracket 20 can be pinned together, assuring proper alignment and distribution of reaction forces caused by the bearing seat 850 of bracket 20 and it's other attachment mechanisms with foundation 10.

Each frame arm 400 also includes one or more stabilizing devices for stabilizing the pier while it is being driven into the ground during the pier driving process. According to the present embodiment, the stabilizing devices include pier guides 420[AS2] attached to the inner sides of arms 400, for example, using attachment devices 425. In accordance with one embodiment, pier guides 420 are removably attached to attachment devices 425 using an interlocking relationship. Accordingly, as the pier is driven in to the ground, pier guides 420 can be used in conjunction with attachment devices 425*a* and 425*b* to aid in the continued alignment and installation of the pier 30. Of course, depending on the height of the pier and the need for additional stabilization, any number of stabilizing devices can be used simultaneously during the pier driving process.

Frame arms 400, in accordance with this embodiment, further include integral attachment holes 430. As described above in connection with FIG. 1, attachment holes 430 are configured to receive attachment devices such as bolts or some other type of attachment mechanism. Also, as shown in FIG. 2, multiple sets of integral attachment holes can be provided along the length of the pier-driving frame 40 depending on the length of the frame needed. Also, shown in FIG. 2 with respect to pier-driving frame 40 is cylinder receptacle 440. Cylinder receptacle 440 is designed to receive cylinder 50 (FIG. 1) and hold it in place during the pier-driving process.

Figure 3:
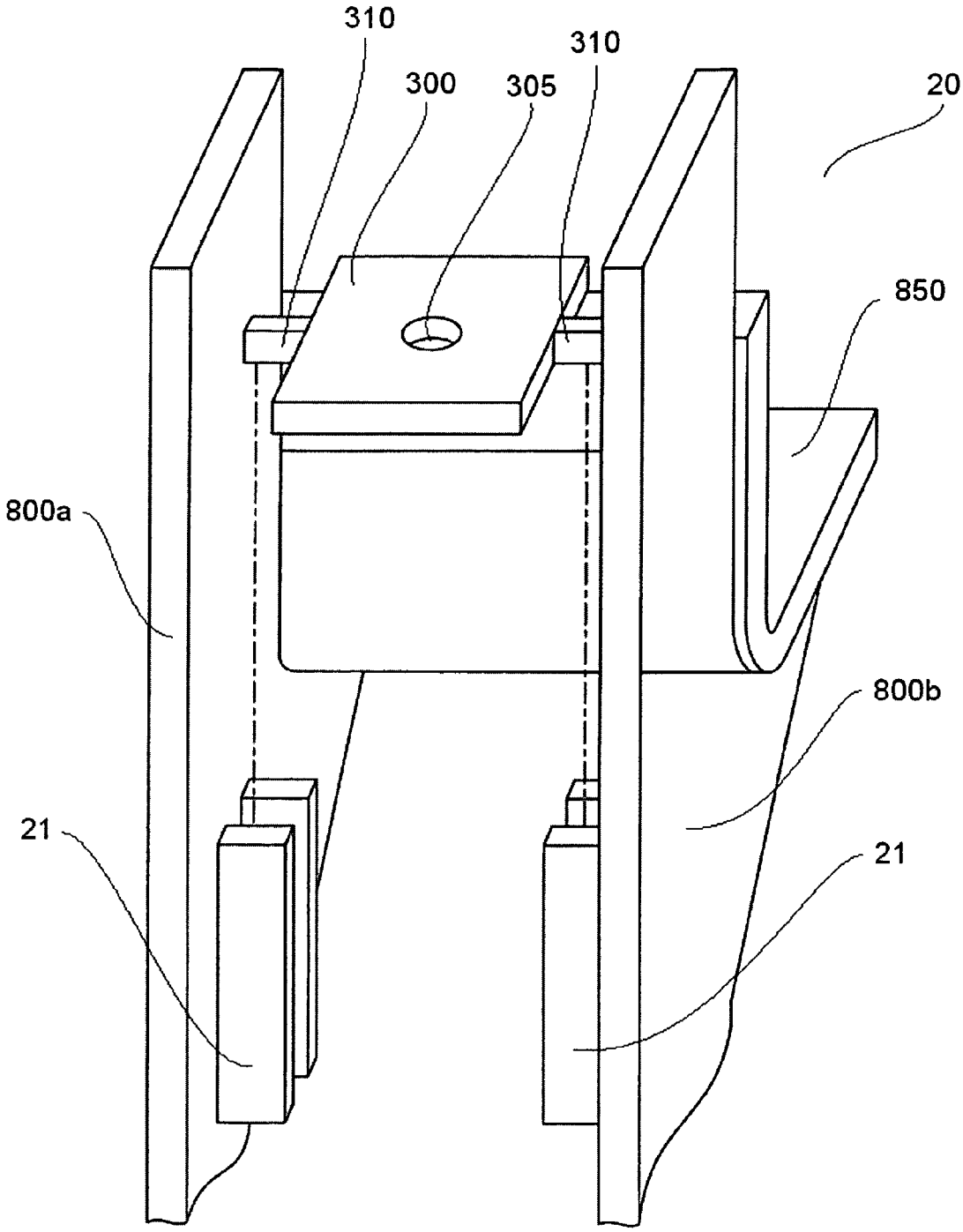
FIG. 3 is a perspective view of a bracket for lifting heavy objects in accordance with one embodiment of the present invention.
Figure 4:
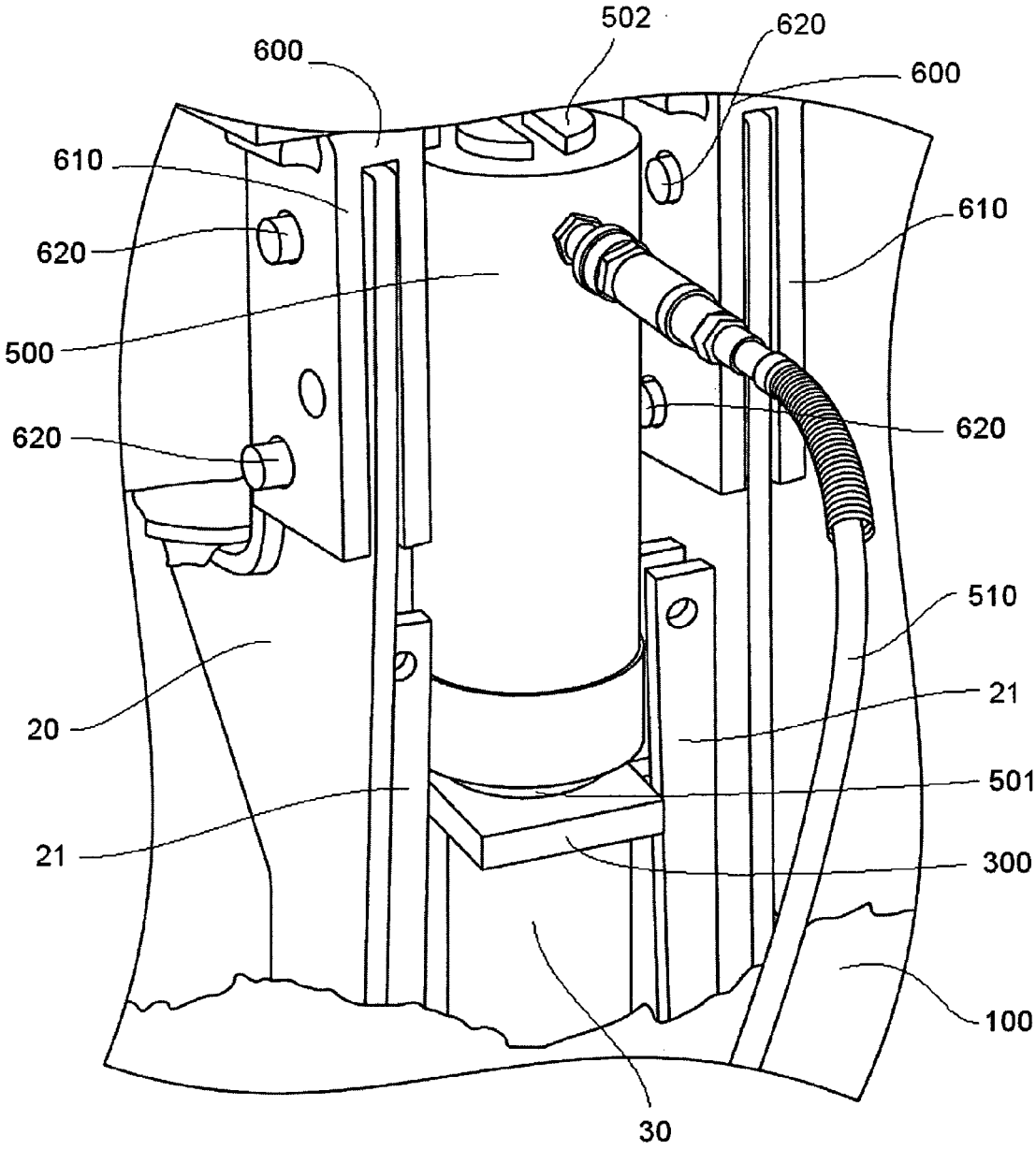
FIG. 4 is a perspective view of the bracket of FIG. 3 during a lifting process in accordance with one embodiment of the present invention.
Figure 5:
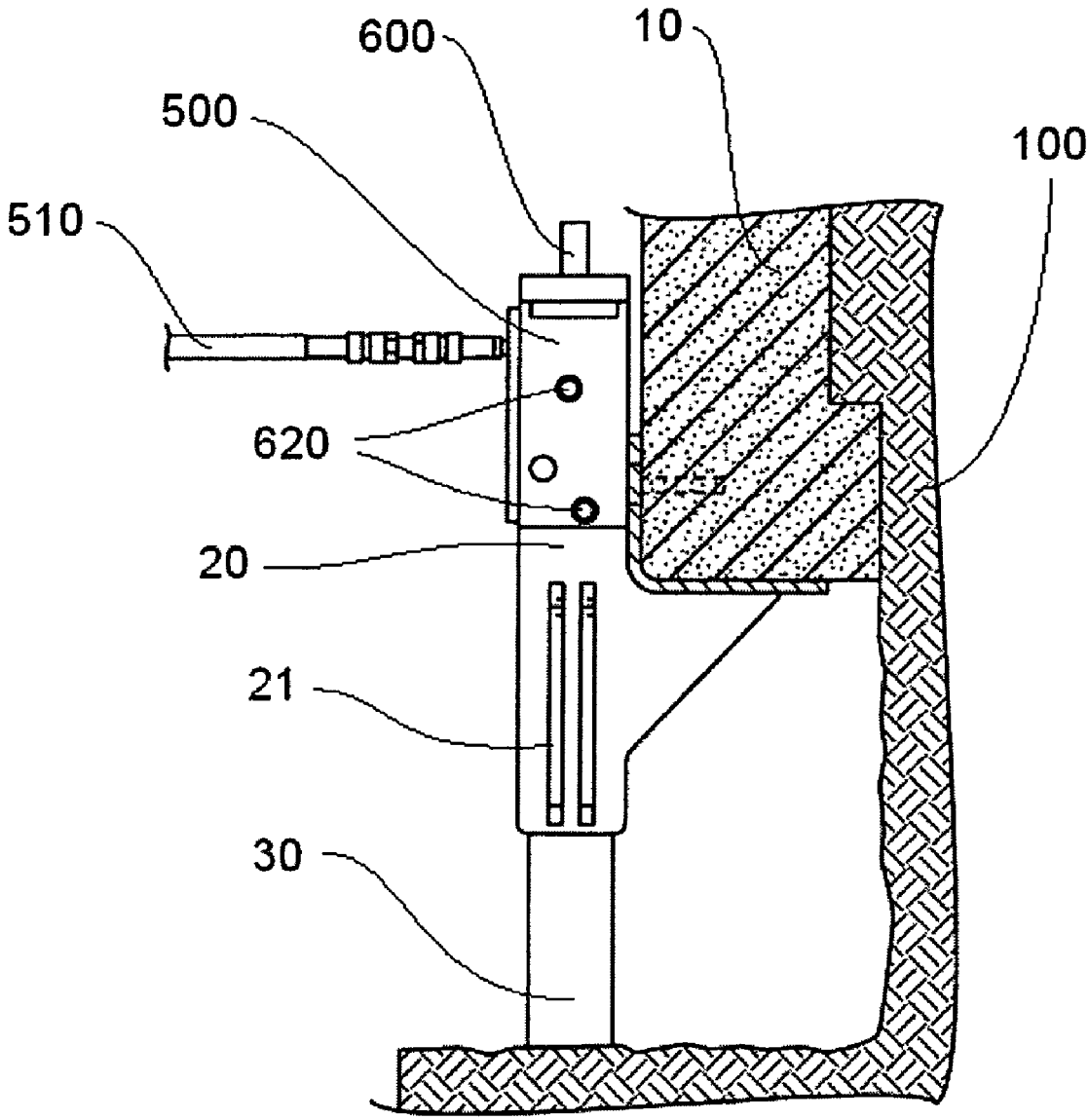
FIG. 5 is a side view of the bracket of FIG. 3 during a lifting process in accordance with one embodiment of the present invention.

Referring now to FIGS. 3-6 the process for lifting the object to be lifted, here foundation 10, will be described. First, as shown in FIG. 3 projection arms 310 of top pier platform, or plate, 300, are respectively inserted between side tracks 21 of bracket 20. The top pier platform 300 is ultimately placed on top of pier 30, as shown in FIG. 4, and provides a surface against which jack 500 can press when in operation. In accordance with the embodiments shown, pier platform 300 includes a grout hole 305 through its center. The grout hole in the pier platform is approximately 1 9/16 inches in diameter and allows for the placement of grout into the pier pipe, if desired, after the pier platform 300 is in place. Grout, for example, is added in the pier 300 to provide additional stability to the pier. Additionally, reinforcement rod or a threaded rod can be placed within the grout column in the pier through the grout hole 305. Grout hole 305 also allows for an easier removal of the top pier platform should the need arise.

Figure 6:
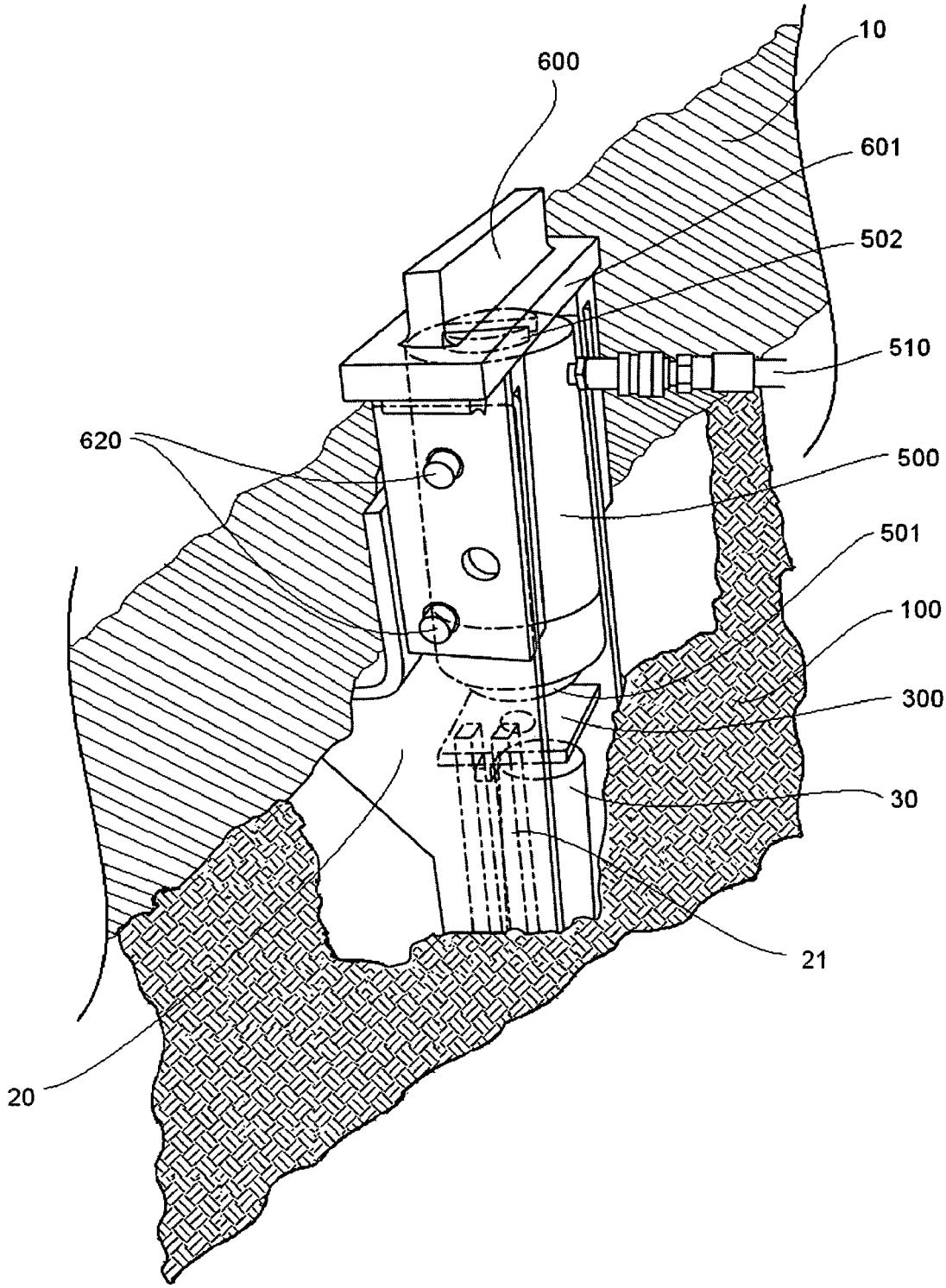
FIG. 6 is an exploded view of the bracket of FIG. 3 during a lifting process in accordance with one embodiment of the present invention.

As shown in FIGS. 4 and 6, lifting frame 600 is removably connected to the top of bracket 20 in similar fashion as pier-driving frame 40 was aligned with bracket 20 in reference to FIG. 1. In particular, lifting frame 600 includes a pair of inverse U-shaped lower arms 610 that overlap the top of bracket 20. Further, because it is desired for the bracket 20 and the lifting frame to be fixed, relative to each other, during the lifting process, attachment pins 620 are placed through holes in lower arms 610 that align with corresponding holes in the top portion of bracket 20. Jack 500 is placed between top pier platform 300 and the upper lid portion 601 of lifting frame 600. Jack 500 can be utilized in an upright or inverted position. Steel plate shims can be used to reduce jacking height to aid in the prevention of over-stroking jack 500, As hydraulic fluid is delivered to jack 500 through hose 510, the jack rod 501 of jack 50 extends outward between top pier platform 300 and against the upper lid portion 601 of lifting frame 600. Accordingly, because pier 30 is securely driven into a suitable bearing material or bedrock, including necessary factor of safety and can not be driven further down into the ground, as the jack rod 501 continues to push between the top pier platform 300 and the upper lid portion 601 of lifting frame 600 the lifting frame is lifted upward. Further, because the frame 600 is attached to bracket 20 which extends beneath foundation 10, through pins 620, and bracket 20 is attached to foundation 10 through bolts 13 (FIG. 1), the foundation also is lifted upwards.

Figure 7:
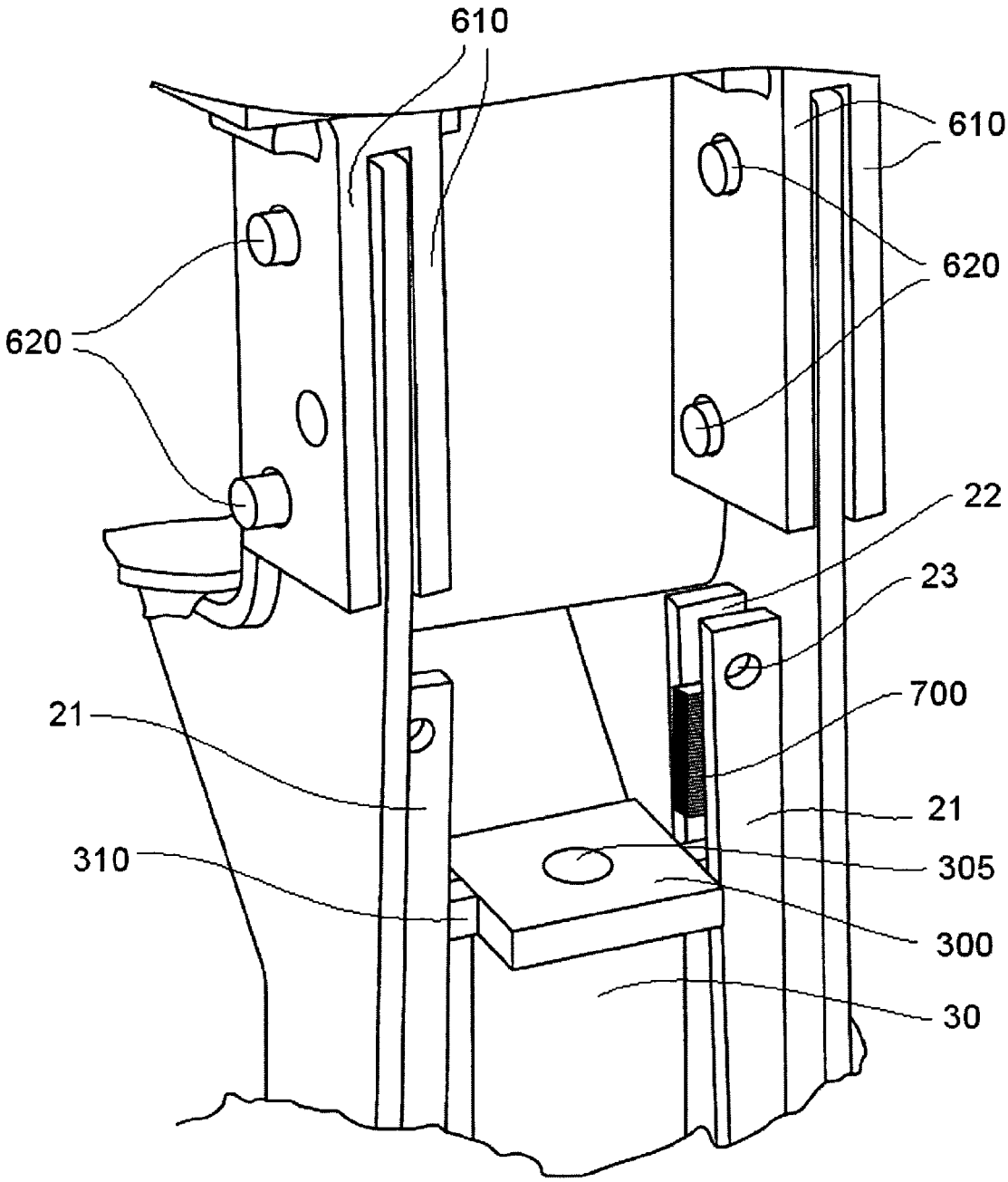
FIG. 7 is a close-up view of the bracket of FIG. 3 at the completion of a lifting process in accordance with one embodiment of the present invention.

When it is determined that the foundation 10 has been sufficiently lifted, stabilized or other wise enhanced further extension of jack 500 is halted. At this point it is desirable to support bracket 20 and foundation 10 such that jack 500 and lifting frame 600 can be removed. One method for providing such support in accordance with the present invention is to insert shims 700 or some other device sufficient to withstand the pressure exerted by the load of foundation 10. In particular, as illustrated in FIG. 7, after the foundation 10, or other lifted object, has been lifted to the desired height, one or more shim devices 700 are placed within the channel 22 created between the two side track pieces 21 of bracket 20. Shims 700 rest on projection arm 310 of top pier platform 300.

A sufficient amount of shim material is inserted into one or more of the channels 22 to fill the space in channel 22 between projection arm 310 and hole 23 in side track piece 21. Once this space has been filled with shim material, a stopper, such as a bolt or a pin (not shown) is inserted through corresponding holes 23 in the parallel side track pieces forming channel 22. At this point, the structure load is permanently transferred to the entire assembly and jack 500 and frame 600 can be removed because bracket 20 and, thus, foundation 10, are sufficiently supported on pier 30. That is, bracket 20 is prevented from moving downward because the stopper device through corresponding holes 23 is in contact with shims 700 which are in contact with projection arm 310 of top pier platform 300, which is in contact with pier 30; and pier 30, as discussed above, is not forced downward by the weight of foundation 10.

An exemplary bracket in accordance with the apparatus described in FIGS. 1-7 will now be described. In particular, a bracket in accordance with the invention disclosed herein overcomes the issues related with the problematic brackets described above in regard to conventional brackets and, specifically, is more sturdy, less expensive and easier to manufacture than conventional brackets used with related art apparatuses.

Figure 8A:
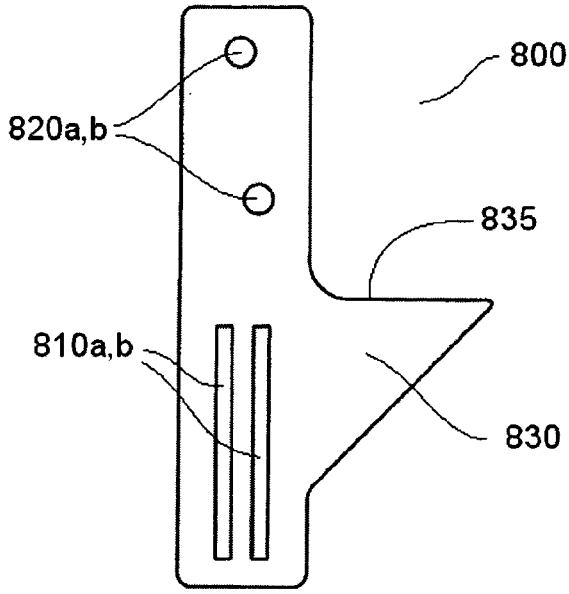
FIGS. 8A-8D are views of the respective components of the bracket of FIG. 3 in accordance with one embodiment of the present invention.

FIGS. 8A-8D illustrate the basic components of a bracket in accordance with the present embodiment. In particular, FIG. 8A is a side view of a shoe-side plate 800. Side plate 800 comprises a single piece of solid metal, typically cut or stamped from a sheet of metal approximately 3/8$^{th}$ inches to ½ inches in width. Each bracket (20 in FIGS. 1-7) includes at least two side plates 800, as described in further detail below. Further, in accordance with this embodiment, side plates 800 include two parallel slots 810*a*, 810*b* and at least two holes 820*a*, 820*b*. A substantially triangular ledge portion 830 is located on one side of side plate 800 and provides an upper ledge surface 835 that is perpendicular to slots 810.

Figure 8B:
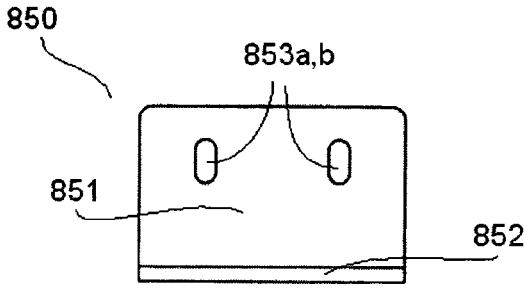
Figure 8C:
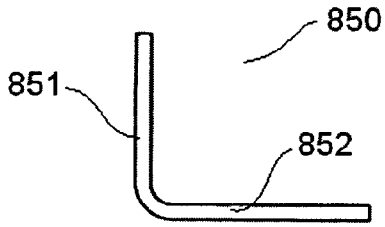

FIGS. 8B and 8C are front and side views, respectively, of an L-shaped seat 850 which includes a vertical back plate 851 and a horizontal plate 852. Additionally at least one hole 853 is cut through back plate 851. In this embodiment holes 853 are oval but other shapes can also be used. Seat 850 shown in accordance with this embodiment is made of one single piece of metal, bent into the exemplary L-shape. However, it is contemplated that back plate 851 and horizontal plate 852 could be constructed of two independent components.

Figure 8D:
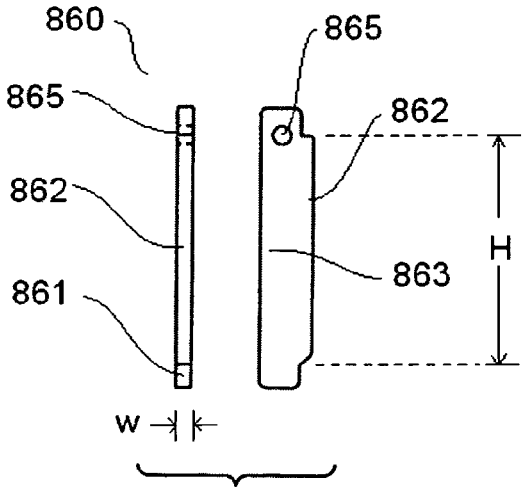

FIG. 8D is a front view and a side view of side track piece 860. Side track piece 860 is a solid piece of metal having a long main portion 861 and a shorter extension portion 862. Further, main portion 861 includes a hole 865 through an uppermost portion thereof. According to this embodiment, extension portion 862 is approximately the same height (h)

and width (w) as slots 810 in side plate 800. Accordingly, as discussed further below, extension portion 862 fits into and interlocks with slot 810.

Figure 9A:
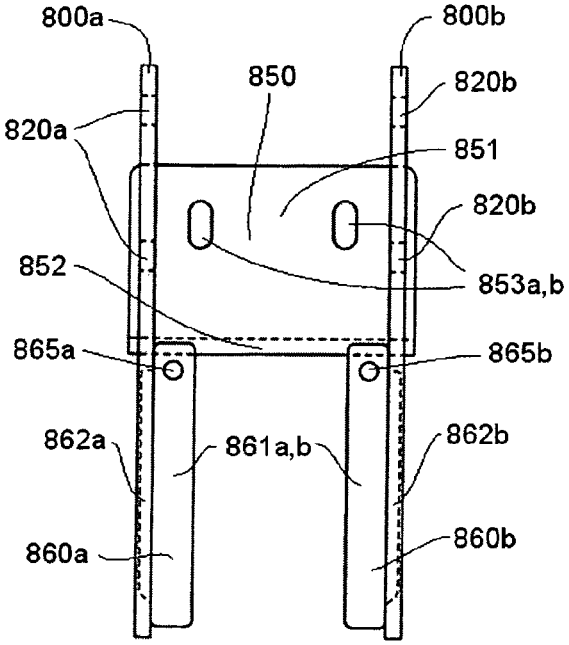
FIGS. 9A-9C are front, side and top views, respectively, of the assembled components of FIGS. 8A-8D in accordance with one embodiment of the present invention.
Figure 9B:
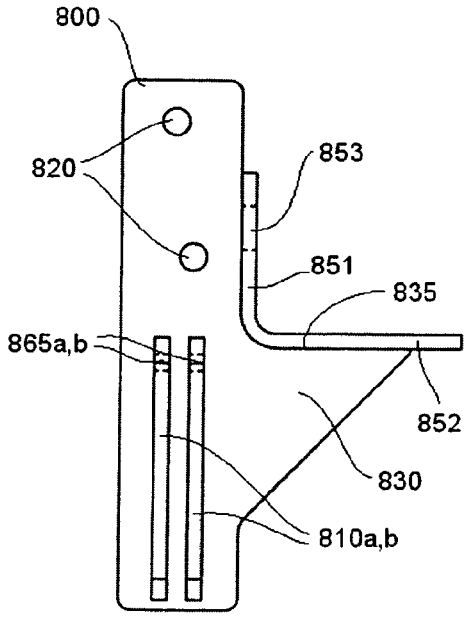
Figure 9C:
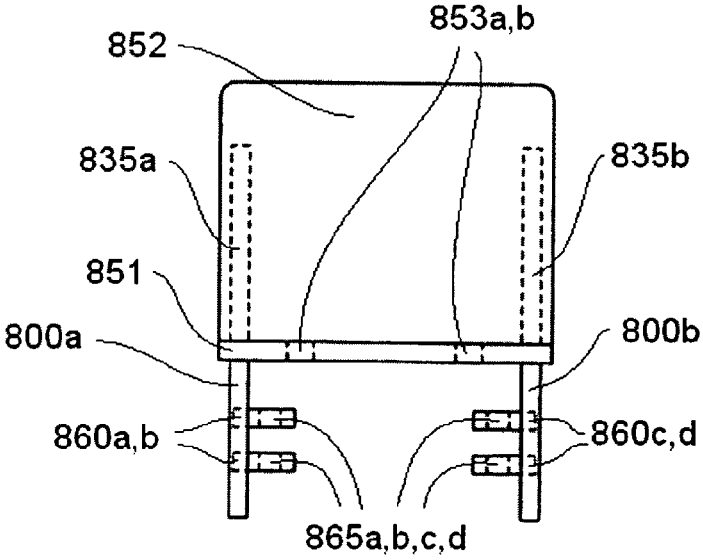
Figure 10A:
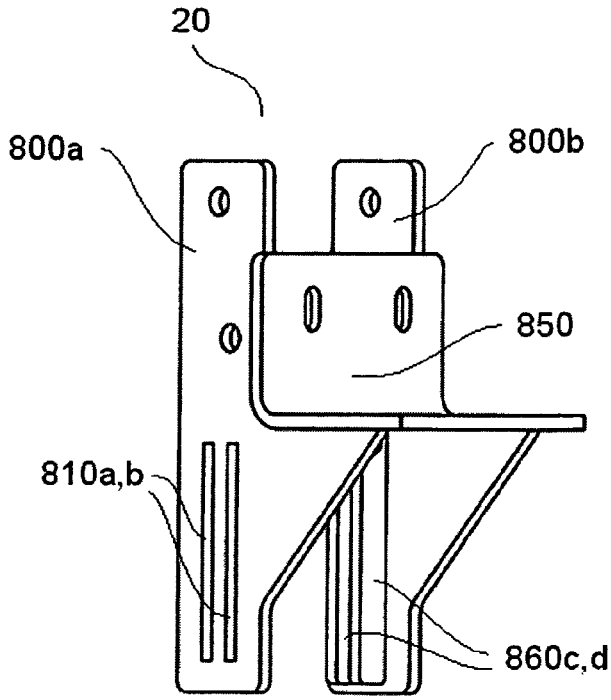
FIGS. 10A-10B are perspective side and top, respectively, of the assembled components of FIGS. 8A-8D in accordance with one embodiment of the present invention.
Figure 10B:
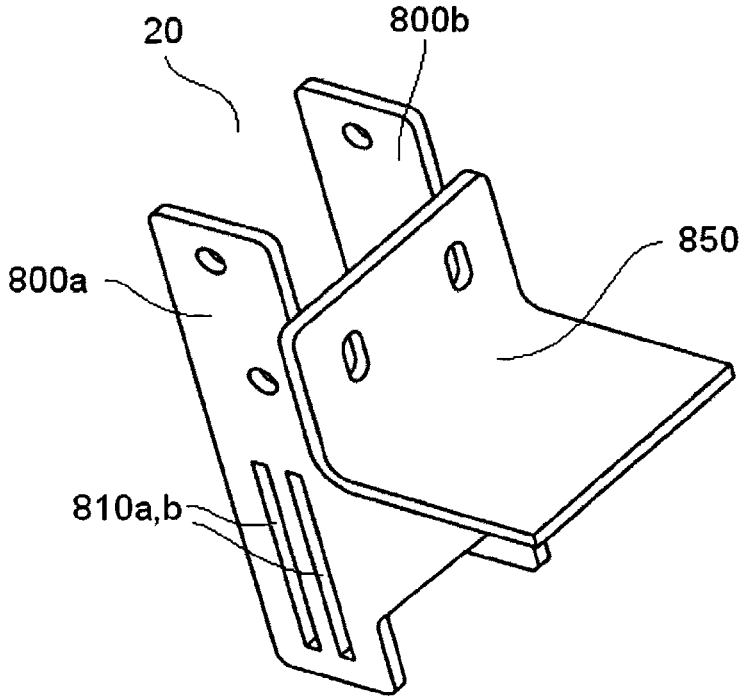

FIGS. 9A-9C are front, side and top views, respectively, of a bracket in accordance with the present invention. Additionally, FIGS. 10A and 10B are side and top perspective views, respectively, of a bracket in accordance with the present invention. Bracket 20 shown in FIGS. 9A-9C and 10A-10B is identical to bracket 20 described above in connection with FIGS. 1-7 and includes one or more of each of the components pieces described in connection with FIGS. 8A-8D. Specifically, bracket 20 in accordance with this embodiment includes two side plates 800*a*, 800*b*, one seat 850 and four side tracks 860*a*, 860*b*, 860*c* and 860*d*. As shown, the horizontal plate 852 of seat 850 rests on top of upper ledge surface 835 of side plate 800.

Referring back to FIGS. 1-7, it is realized that bolts 12 (FIG. 1) which attach bracket 20 to foundation 10 pass through holes 853 in seat 850. Also, as described in connection with FIG. 7, holes 23 through which a pin, screw, bolt or some other device is placed once the object being lifted has been so sufficiently, correspond to holes 865 shown in FIGS. 9A-9C.

Figure 11A:
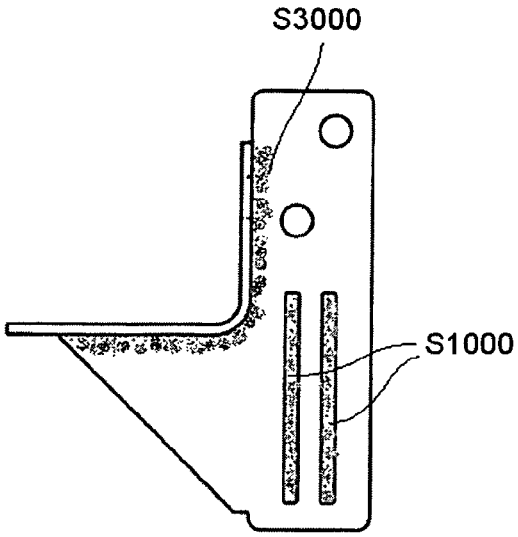
FIGS. 11A-11C are outside, back and inside views, respectively, of the bracket of FIGS. 9A-9C and 10A-10B, specifically illustrating the welding process of the bracket in accordance with one embodiment of the present invention.
Figure 11B:
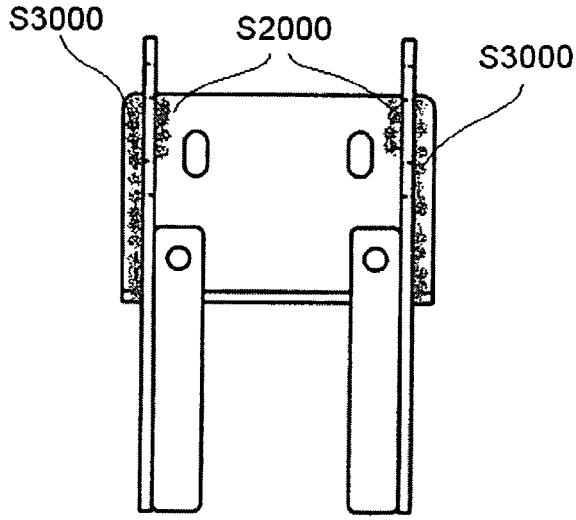
Figure 11C:
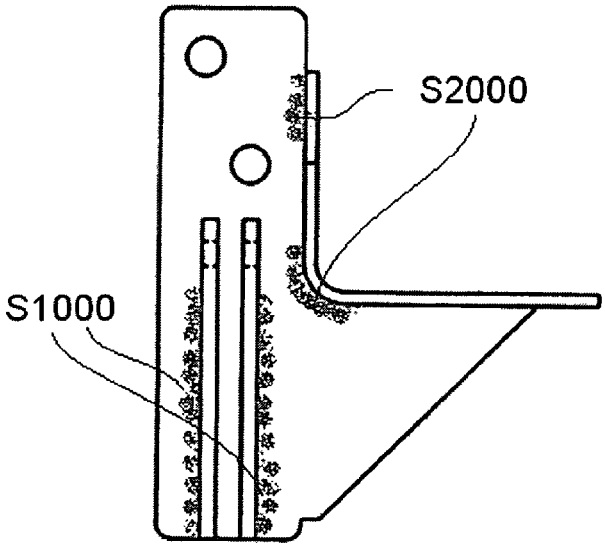

FIGS. 11A-11C illustrate an exemplary manufacturing process for assembling a bracket such as bracket 20 described above. In particular, according to this embodiment, the side track pieces are first welded in place into the slots of the shoe side plates, S1000. More particularly, the side track pieces are placed into the slots from the inside of the side plate, that is, the side that will be facing towards a second side plate, and welded into place along substantially the entire length of the slot. On the inside surface of the side plates the side track pieces are welded on the respective outer corners as shown in FIG. 11C; that is, for ease of welding, it is not desirable to attempt to weld between the two side track pieces. Additionally, on the outside surface of the side plates the side track pieces are welded to the side plates by providing a weld along substantially the entire length of the slot and substantially within the dimensions of the slot.

After the four side track pieces have been welded to the respective side plates (S1000), the L-shaped seat is welded to the side plates, S2000. For example, a weld is provided in the corner where the seat transitions from a vertical back portion to a horizontal seat and a second weld is provided at the upper portion of the vertical back portion. After the welds in accordance with S1000 and S2000 are complete, the bracket is substantially joined together. Additionally, to provide further rigidity in the construction of the bracket, a weld is provided along substantially the entire length of the seat on the outside surface of the side plates, i.e., where the seat meets the respective side plates, S3000.

While various aspects of the present invention have been particularly shown and described with reference to the exemplary, non-limiting, embodiments above, it will be understood by those skilled in the art that various additional aspects and embodiments may be contemplated without departing from the spirit and scope of the present invention. For example, a skilled artisan would understand that various sizes of bracket 20 can be employed depending on the specific application. That is, as the weigh of the object being lifted with the lifting apparatus increases, the size and dimensions, including the width of the material used to manufacture the bracket, also increases, as does the diameter of the pier used to support the object once the lifting process is complete.

It would be understood that a device or method incorporating any of the additional or alternative details mentioned above would fall within the scope of the present invention as determined based upon the claims below and any equivalents thereof.

Other aspects, objects and advantages of the present invention can be obtained from a study of the drawings, the disclosure and the appended claims.

What is claimed is:

1. A device for lifting, stabilizing or enhancing load capacities of an object, the device comprising:

a pair of parallel side plates, each including a lateral seat portion and at least two vertical slots therethrough, each side plate having an inner surface, wherein the inner surface of each of the parallel side plates faces the inner surface of the other side plate, and each side plate further has an outer surface that faces away from the other side plate;

a lifting plate having respective horizontal and vertical members, wherein the horizontal member of said lifting plate contacts the lateral seat portion of said side plates; and at least four side track pieces respectively corresponding to the vertical slots of said side plates and extending at least partially through the slots, wherein the side track pieces are configured for an interlocking fit into said slots.

2. The device claimed in claim 1, wherein said side track pieces each comprise:

a tab that has a side dimension that is substantially the same as a corresponding slot in the side plate into which it is inserted; and an extension portion which is longer than said tab, wherein the tab of each respective side track piece is inserted into its respective slot from the inner surface of the respective side plate.

3. The device claimed in claim 1, wherein the vertical slots of each of said side plates are parallel and located at a first end of said side plate and each of said side plates further includes at least one hole disposed at a second end of said side plate opposite the first end.

4. An apparatus for lifting, stabilizing or enhancing load capacities of an object, the apparatus comprising:

a pier suitable to support at least the load of the object;

a bracket operable to engage the object and said pier, said bracket having a pair of parallel side plates and each side plate having at least two slots extending therethrough, a lifting plate perpendicular to and fixedly attached to the side plates at opposite ends thereof, and a guide track formed by parallel side track members perpendicularly attached to opposing inside surfaces of respective side plates, said side track members corresponding to the slots in the side plates and extending at least partially therethrough;

a pier platform disposed on top of said pier and having at least one guide member operable to engage the guide track of said bracket.

5. The apparatus claimed in claim 4, wherein said pier platform includes a hole through the center thereof, wherein the hole in said pier platform is in alignment with said pier.

6. The apparatus claimed in claim 4, further comprising:

a lifting frame removably attached to said bracket; and a lifting device operable to move said lifting frame and said bracket away from said pier platform.

7. The apparatus claimed in claim 6, wherein said pier platform includes two guide members on respective sides of said pier platform, wherein the guide members of said pier platform respectively engage the guide track and maintain said bracket in alignment with said pier.

8. The apparatus claimed in claim 4, wherein the side track members are interlocked into respective slots in the side plates of said bracket.

9. The apparatus claimed in claim 8, wherein the side plates of said bracket further include a main body portion and a seat portion extending out from the main body portion, wherein the slots in the side plates are disposed in the main body portion adjacent to the seat portion.

10. The apparatus claimed in claim 9, wherein the lifting plate comprises a horizontal base fixedly attached to the seat portion of said side plates and a vertical back portion is fixedly attached to the main body portion of said side plates.

11. A method for lifting, stabilizing or enhancing load capacities of an object, the method comprising:

inserting a pier into the earth adjacent to the object;

engaging the object with a bracket in alignment with a top of the pier, the bracket having a guide track formed by inserting side track pieces at least partially through slots extending through side plates of the bracket;

placing a pier platform on top of the pier, wherein the pier platform engages the guide track;

lifting the bracket and the object; and sliding the guide track relative to the pier platform during said lifting.

12. The method claimed in claim 11, further comprising:

placing a shim on the pier platform when said lifting is complete; and supporting the object on the shim.

13. The method claimed in claim 12, further comprising:

placing the shim in the guide track between two respective side track pieces; and inserting a locking device through respective holes in the side track pieces, wherein the object is supported by the locking device contacting the shim, which contacts the pier platform on top of the pier.

14. The method claimed in claim 11, further comprising providing a stabilizing object or material into the pier through a hole in the pier platform.

15. The method claimed in claim 14, wherein the stabilizing object or material comprises at least one of grout and a stabilizing rod.

16. A method for making a bracket that is used for lifting, stabilizing or enhancing load capacities of an object, the method comprising:

attaching two parallel side plates to an L-shaped support member at opposite ends thereof; and inserting two side track pieces at least partially into respective slots through each of the side plates, wherein the side track pieces are perpendicular to the side plates.

17. The method claimed in claim 16, wherein said attaching comprises welding.

18. The method claimed in claim 17, further comprising:

welding the side track pieces to their respective side plates at an outside surface of the side plate within the slot;

welding the side track pieces to their respective side plates at an inside surface of the side plate at the junctions where the side track pieces meet the side plate, wherein the weld is on the sides of the side track pieces away from the corresponding other side track piece associated with the respective side plate;

after welding the side track pieces to their respective side plates, welding the two parallel side plates to the L-shaped support member, wherein two welds are located respectively at the corner and at the top of the L-shaped support member and between the two side plates;

after welding the two parallel side plates to the L-shaped support member at the corner and at the top of the L-shaped support member between the two side plates, welding the two parallel side plates to the L-shaped support member at the outside of the side plates and along the entire length of the L-shaped support member.

19. A device for lifting, stabilizing or enhancing load capacities of an object, the device comprising:

a pair of parallel side plates, each including a lateral seat portion and at least two vertical slots therethrough, each side plate having an inner surface, wherein the inner surface of each of the parallel side plates faces the inner surface of the other side plate, and each side plate further has an outer surface that faces away from the other side plate;

a lifting plate having respective horizontal and vertical members, wherein the horizontal member of said lifting plate contacts the lateral seat portion of said side plates;

at least four side track pieces respectively corresponding to the vertical slots of said side plates and extending at least partially through the slots, wherein the side track pieces are configured for an interlocking fit into said slots; and at least two first welds attaching the side track pieces to their respective side plates at an inside surface of the side plate at the junctions where the side track pieces meet the side plate, wherein the welds are on the sides of the side track pieces away from the corresponding other side track piece associated with the respective side plate.

20. The device claimed in claim 19, further comprising, at least two second welds attaching the two parallel side plates to the lifting plate and located respectively at the corner and at the top of the lifting plate and between the two side plates; and at least two third welds attaching the two parallel side plates to the lifting plate at the outside of the side plates and along the entire length of the lifting plate.

* * * * *